US005341847A

United States Patent [19]

Rissik et al.

[11] Patent Number: 5,341,847

[45] Date of Patent: Aug. 30, 1994

[54] UNDERWATER CLEANING APPARATUS

[76] Inventors: George V. Rissik, 66 Goethe Road, Lombardy East, Transvaal Province; Wilbraham C. K. Vickers, 21 Lucas Road, Eastleigh, Edenvale, both of South Africa

[21] Appl. No.: 143,196

[22] Filed: Oct. 25, 1993

[30] Foreign Application Priority Data

Aug. 12, 1993 [ZA] South Africa ..... 93/5867

[51] Int. Cl.[5] ..... F16K 11/052

[52] U.S. Cl. ..... 137/875

[58] Field of Search ..... 137/625.44, 875

[56] References Cited

U.S. PATENT DOCUMENTS

| | | | |
|---|---|---|---|
| 4,023,227 | 5/1977 | Chauvier . | |
| 4,351,077 | 9/1982 | Hofmann . | |
| 4,401,301 | 8/1983 | Hayshar | 137/625.44 X |
| 4,530,125 | 7/1985 | Hofmann . | |
| 4,907,619 | 3/1990 | Paulsey | 137/875 |

*Primary Examiner*—John C. Fox

*Attorney, Agent, or Firm*—Marshall, O'Toole, Gerstein, Murray & Borun

[57] ABSTRACT

Underwater cleaning apparatus of a general type well-known includes a chamber having an inlet on one side thereof and a pair of outlets on the other side communicating with a pair of passages adapted for connection to a suction hose; a pair of valve seats for the outlets; a valve closure arrangement for the valve seats; a valve closure arrangement including a body, preferably of cylindrical segmental shape, mounted in the chamber to pivot about an axis perpendicular to the plane through the axis of the valve seats and including a closure for each seat with the closures disposed relative to each other and parallel to the pivotable axis such that the closures may close the valve seats alternately on oscillation of the valve body about its axis; and a curved surface connecting the closures with the surface being concavely profiled at least the areas adjacent the closures.

7 Claims, 2 Drawing Sheets

UNDERWATER CLEANING APPARATUS

INTRODUCTION TO THE INVENTION

This invention relates to cleaning apparatus for cleaning surfaces underwater such as the surfaces of swimming pools for example.

BACKGROUND TO THE INVENTION

In the specification of our earlier South African Patent No 90/6421 entitled "Underwater Cleaning Apparatus" we described a cleaning apparatus of the type having a flexible circular member which surrounds the inlet to a chamber in a body for the apparatus. On the opposite side of the chamber to the inlet are two substantially co-planar outlets which lead to two passages. These passages combine at a position remote from the outlets and are connected to a flexible suction hose in known manner.

Within the chamber is a closure arrangement for alternately closing and opening the outlets to interrupt the water flow in the passages and cause the apparatus to move over a surface to be cleaned. This way of effecting movement of apparatuses of this type is well-known.

The closure arrangement comprises a pivotable body having two closures provided by two flat surfaces extending at an angle of about 145° to each other (although this angle may vary considerably) and having the pivot point near the apex formed by the surfaces. The body includes a curved surface extending between the flat surfaces, the curved surface fulfilling a function of directing water flow to one side or other of the body depending on which outlet is open.

A problem encountered in the above configuration is that it is sometimes difficult for large physical bodies to pass through the chamber without obstructing or being caught by the closure arrangement.

An object of this invention is to provide a closure arrangement which allows for the improved passage of bodies through the chamber.

SUMMARY OF THE INVENTION

According to the invention, underwater cleaning apparatus includes a chamber having an inlet on one side thereof; a pair of outlets on the other side of the chamber and communicating with a pair of passages; a pair of valve seats for the outlets and housing their axes in the same plane; and a valve closure arrangement for the valve seats, the valve closure arrangement including a body mounted in the chamber to pivot about an axis perpendicular to the plane through the axes of the valve seats and including a closure for each seat with the closures disposed relative to each other and parallel to the pivotal axis such that the closures are adapted to close the valve seats alternately on oscillation of the valve body about its axis; and a curved surface connecting the closures, the curved surface being concavely profiled at least at the areas adjacent the closures.

Further according to the invention the closures are provided by closure surfaces of the body.

Still further, according to the invention the curved surface is concavely profiled along its length between the closures.

Still further, according to the invention, the passages are provided by parallel pipes, the valve seats are formed by the ends of the pipes projecting into the chamber, and the valve seats are substantially co-planar.

Still further, according to the invention, the body is of segmental cylindrical shape in plan and preferably the subtended angle of the segment is about 145°.

BRIEF DESCRIPTION OF THE DRAWINGS

One embodiment of the invention is described below by way of example only and by reference to the accompanying drawings in which.

DETAILED DESCRIPTION OF THE PREFERRED EMBODIMENT OF THE INVENTION WITH REFERENCE TO THE DRAWINGS

In this embodiment of the invention a valve arrangement for a cleaning apparatus for the underwater surfaces of swimming pools or the like is provided.

Figure 1:
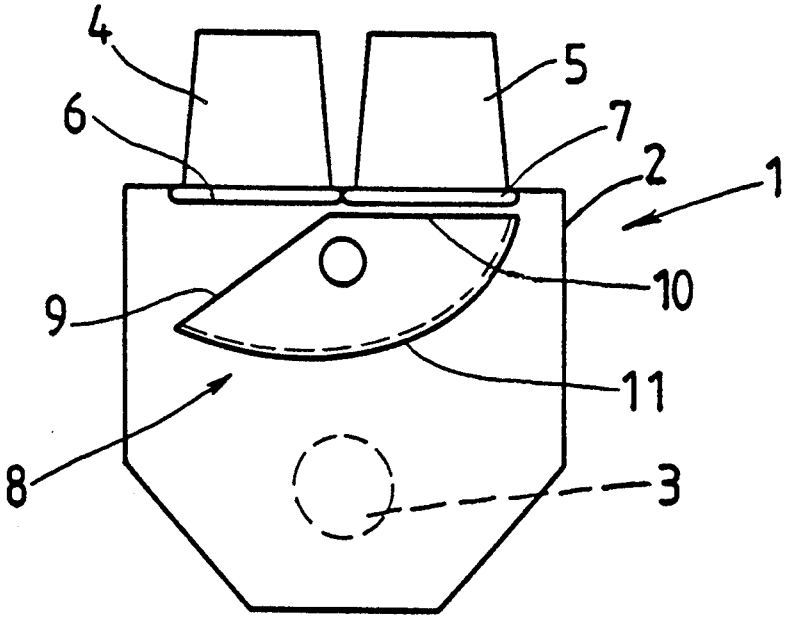
FIG. 1 is a diagrammatic sketch of part of a cleaning apparatus for the underwater surface of a swimming pool according to the invention.

As illustrated in FIG. 1, the valve arrangement (1) is located in a chamber (2) of the cleaning apparatus which has a circular flexible suction foot and is connected by a flexible suction pipe to the filter assembly for the swimming pool. These features are well known in the art of swimming pool cleaners.

The chamber (2) includes an inlet (3) from the opposite side of the suction foot and on one side of the chamber. On the other side of the chamber are the ends of two pipes (4) and (5) which combine at a position remote therefrom into a single pipe which is adapted to be connected to the filter system of the swimming pool by way of a flexible suction hose.

In the chamber (2) the pipes (4) and (5) terminate in circular valve seats (6 and 7). The valve seats (6) are furthermore substantially co-planar and have their axes substantially parallel to each other.

Also located within the chamber (2) is a valve body (8) formed from a hollow plastic material which has a shape in plan of a segment of a right circular cylinder. Two plane adjacent side surfaces of the body (8) are at an angle of about 145° to one another and form valve closures (9) and (10) to valve seats (6 and 7) respectively, the opposite side (11) of the body being of circular arcuate form.

The arcuate side (11) of the body is furthermore concavely profiled along its length such that the line of intersection with each of the side surfaces is a concave curve (12).

The valve body (8) is pivotably mounted between opposing walls of the chamber (2) to permit pivoting of the valve about an axis within the body parallel to the plane of the valve seats within the extreme positions of closure thereof.

Figure 2:
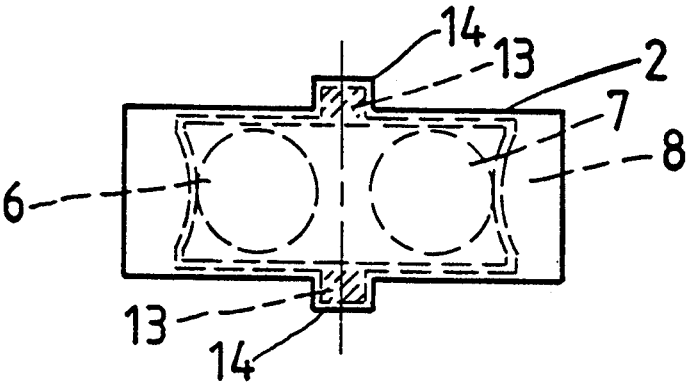
FIG. 2 is a side view of the valve body of the arrangement of FIG. 1 as mounted in the chamber; and, FIG. 3 is a view of the curved surface of the valve body.
Figure 3:
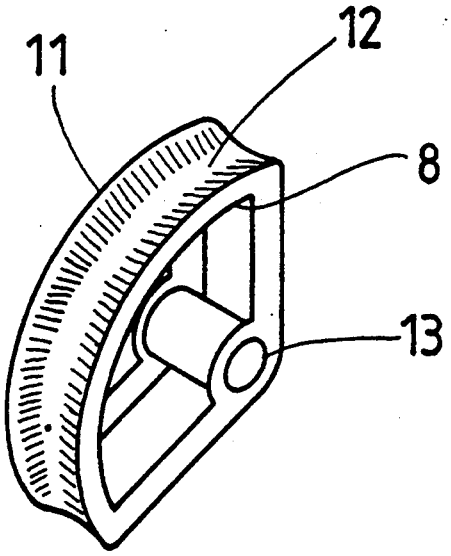

Mounting of the valve body (8) within the chamber is illustrated in FIG. 2. On the outside of the body are boss formations (13) positioned near the apex of the body and which are loosely and pivotably located in corresponding formations (14) in the opposing walls of the chamber (2).

In use, when suction is applied to the two pipes (4) and (5) by the filter assembly of the swimming pool, one of the valve closures (10) will be sucked preferentially on to its valve seat (7). When this happens, the pressure in that pipe will decrease until the valve closure (10) is released, and the other valve closure (9) is drawn onto the valve seat (6), where the flow through the pipe, and hence the suction, has been maximised.

The process is repeated rapidly thus effecting movement of the apparatus over the surface of the pool in known manner.

It will be appreciated that the concave profile along the surface of the arcuate side (11) and at the line of intersection of the arcuate side (11) and the sides acts as a guide for water flow and also provides an area of increased size between the body and the side walls of the chamber through which particles such as leaves, sticks and the like may pass.

It is envisaged that the valve arrangement described above will provide a simple arrangement for pool cleaning equipment of the type described.

Other embodiments are envisaged within the scope of the invention, including other shapes, configurations and applications thereof.

What I/We claim as new and desire to secure by Letters Patent is:

1. Underwater cleaning apparatus including a chamber having an inlet on one side thereof; a pair of outlets on the other side of the chamber and communicating with a pair of passages; a pair of valve seats for the outlets and having their axes in the same plane; and a valve closure arrangement for the valve seats, the valve closure arrangement including a body mounted in the chamber to pivot about an axis perpendicular to the plane through the axes of the valve seats and including a closure for each seat with the closures disposed relative to each other and parallel to the pivotal axis such that the closures are adapted to close the valve seats alternately on oscillation of the valve body about its axis; and a curved surface connecting the closures, the curved surface being concavely profiled at least at the areas adjacent the closures.

2. Underwater cleaning apparatus as claimed in claim 1 in which the curved surface is concavely profiled along its length between the closures.

3. Underwater cleaning apparatus as claimed in claim 1 in which the closures are provided by closure surfaces of the body.

4. Underwater cleaning apparatus as claimed in claim 1 in which the body is of segmental cylindrical shape in plan.

5. Underwater cleaning apparatus as claimed in claim 4 in which the subtended angle of the segment is about 145°.

6. Underwater cleaning apparatus as claimed in claim 1 in which the passages are provided by parallel pipes, the valve seats are formed by the ends of the pipes projecting into the chamber.

7. Underwater cleaning apparatus as claimed in claim 1 in which the valves seats are substantially co-planar.

* * * * *